US007591678B2

(12) United States Patent
Ikeya et al.

(10) Patent No.: US 7,591,678 B2
(45) Date of Patent: Sep. 22, 2009

(54) THROUGH-PANEL CONNECTOR

(75) Inventors: Kenichi Ikeya, Shizuoka-ken (JP); Shigeru Tanaka, Shizuoka-ken (JP); Yasuhiro Sasaki, Shizuoka-ken (JP); Tsuneyuki Takahashi, Atsugi (JP); Takahiro Yoneda, Atsugi (JP); Ryo Sawada, Atsugi (JP); Ken Yoshimura, Atsugi (JP); Nozomi Ito, Tochigi-ken (JP)

(73) Assignees: Yazaki Corporation, Tokyo (JP); Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 11/661,920

(22) PCT Filed: Sep. 5, 2005

(86) PCT No.: PCT/JP2005/016225

§ 371 (c)(1),
(2), (4) Date: Mar. 4, 2008

(87) PCT Pub. No.: WO2006/028034

PCT Pub. Date: Mar. 16, 2006

(65) Prior Publication Data

US 2008/0261443 A1 Oct. 23, 2008

(30) Foreign Application Priority Data

Sep. 6, 2004 (JP) ..... 2004-258801

(51) Int. Cl.
*H01R 13/73* (2006.01)

(52) U.S. Cl. ..... 439/557

(58) Field of Classification Search ..... 439/556, 439/557, 552, 559, 558, 248, 247; 248/27.3
See application file for complete search history.

(56) References Cited

U.S. PATENT DOCUMENTS 5,775,944 A * 7/1998 Flask et al. ..... 439/556

FOREIGN PATENT DOCUMENTS

JP 48-060754 1/1975

(Continued)

OTHER PUBLICATIONS

"Notification of Reasons for Refusal" mailed Feb. 10, 2009, issued by the Japanese Patent Office in copending Application No. 2004-258801.

*Primary Examiner*—Phuong K Dinh
(74) *Attorney, Agent, or Firm*—Finnegan, Henderson, Farabow, Garrett & Dunner, L.L.P

(57) ABSTRACT

A through-panel connector, comprising a female connector (10) and a male connector disposed on one side and the other side of panel (50) and fitted to each other through a mounting hole (51) formed in the panel (50). The female connector (10) comprises a plurality of flexible holding ribs (11). The holding ribs (11) are formed on the outer peripheral surface (32) of the female connector (10) opposed to the mounting hole inner peripheral surface (53) of the panel (50) so as to be extended along the inserting direction of the mounting hole (51) and separated from the outer peripheral surface (32) while being extended from the base end part (12) to the tip part (13) of the female connector (10) along the mounting hole inner peripheral surface (53). The holding ribs (11) are biased and held on the mounting hole inner peripheral surface (53) with the female connector (10) fitted to the panel (50).

7 Claims, 8 Drawing Sheets

FOREIGN PATENT DOCUMENTS

| | | |
|---|---|---|
| JP | 50-009792 | 1/1975 |
| JP | 55-041777 | 10/1981 |
| JP | 56-143786 | 10/1981 |
| JP | 62-107378 | 7/1987 |
| JP | 1-174884 | 12/1989 |
| JP | 07-065910 | 3/1995 |
| JP | 9-139250 | 5/1997 |
| JP | 2003-346990 | 12/2003 |
| JP | 2005-059697 | 3/2005 |

* cited by examiner

THROUGH-PANEL CONNECTOR

TECHNICAL FIELD

The present invention relates to a through-panel connector which is used in wiring an electric wire through a panel.

BACKGROUND OF ART

This kind of through-panel connector is disclosed in Patent document No. 1. This through-panel connector is provided, on its fixing side, with a female connector having a flexible arm and a latch and is attached to a mounting hole in a panel so as to allow be displaceable to the mounting hole. Again, the female connector is provided, in an insert-side brim part, with an insertion hole broadened at a slant, while a mating male connector is provided with a guide rod having a pointed tip. Further, electrical terminals are arranged in the insertion hole and the guide rod, respectively. The electrical terminal in the guide rod of the male connector is held by a spring part of the electrical terminal in the insertion hole of the female connector, effecting a connection between the terminals. Consequently, even if the connector on the fixing side is misaligned with the mating connector or both of the connectors have dimensional errors in manufacturing, the fitting of the connectors would be carried out in their normal positions, whereby it is possible to do away with defective contact between the terminals and damage thereon and also possible to improve spatial effectiveness of the connector body.

Patent document No. 1: Japanese Patent Laid-Open Publication No. 9-139250

DISCLOSURE OF THE INVENTION

In the conventional through-panel connector, the female connector on the fixing side is fixed on the mounting hole by a claw at the tip end of the flexible arm and the latch 25. However, since there is no technique idea to hold the female connector at the center of the mounting hole, that conventional waterproof connector requires only to align the female connector with the male connector to be mated and does not have a function to hold the connector at the center of the mounting hole.

In the conventional through-panel connector, additionally, when mounting the female connector on the mounting hole, an insertion force gets larger as approaching a root part of the flexible arm. Consequently, a force required at an early stage of fitting gets large, causing the fitting workability to deteriorate.

In order to solve the above-mentioned problems, an object of the present invention is to provide a through-panel connector which is superior in fitting workability and which can be positioned at the center of the mounting hole.

In order to accomplish the above object, in an aspect of the present invention, there is provided a through-panel connector comprising: a first connector housing and a second connector housing which are disposed on one side and the other side of a panel respectively and fitted to each other through a mounting hole formed in the panel, wherein at least one of the first connector housing and the second connector housing has a plurality of flexible holding ribs formed on at least one of both outer peripheral surfaces of the first connector housing and the second connector housing opposed to an inner peripheral surface of the mounting hole, the holding ribs being formed so as to be extended from a base end part standing on the outer peripheral surface and extended along a circumferential direction of the inner peripheral surface of the mounting hole and along the inserting direction into the mounting hole, the holding ribs making contact with the inner peripheral surface of the mounting hole on condition that the at least one of the first connector housing and the second connector housing is mounted on the panel.

According to the aspect of the present invention, since the positioning of the connector is accomplished by inserting the connector into the mounting hole, the positioning to the panel can be simplified and the force required to insert the connector into the mounting hole can be generally equalized from beginning to end, whereby the fitting work can be simplified.

Further, the holding ribs may be formed on the outer peripheral surface at even intervals.

According to the above constitution, since respective biasing and holding forces to the inner peripheral surface of the mounting hole are uniformed, the connector can be centered with respect to the mounting hole by inserting the connector thereinto. Thus, it is possible to accomplish the positioning of the connector to the panel more certainly.

Further, the holding ribs may be provided, on the sides of respective tips of the holding ribs, with engagement projections that are engaged with an opening edge of the mounting hole.

According to the above constitution, since both connector's positioning and assembling to the panel can be performed by a single action owing to the provision of the engagement projections for engagement with the opening edge of the mounting hole on the sides of respective tips of the holding ribs, it is possible to simplify the fitting work.

Still further, the engagement projections may be provided, on the sides of respective base end parts of the holding ribs, with biasing-force adjusting parts, such as slits.

According to the above constitution, owing to the provision of the biasing-force adjusting parts, such as slits, on the sides of respective base end parts of the holding ribs of the engagement projections, it is possible to make a force for mounting the connector on the panel equal to a force for positioning the connector.

Still further, the connector housing having the holding ribs may be provided, on its surface opposed to the panel, with a sealing part that is held between the surface opposed to the panel and the panel on condition that the engagement projections are engaged with the opening edge.

According to the above constitution, the sealing part arranged on the surface of the connector housing having the holding ribs, the surface being opposed to the panel, is held between the surface opposed to the panel and the panel on condition that the engagement projections are engaged with the opening edge. Consequently, it is possible to ensure a fastening span allowing the sealing part to exert sufficient water tightness stably.

BEST MODE FOR CARRYING OUT THE INVENTION

Figure 1:
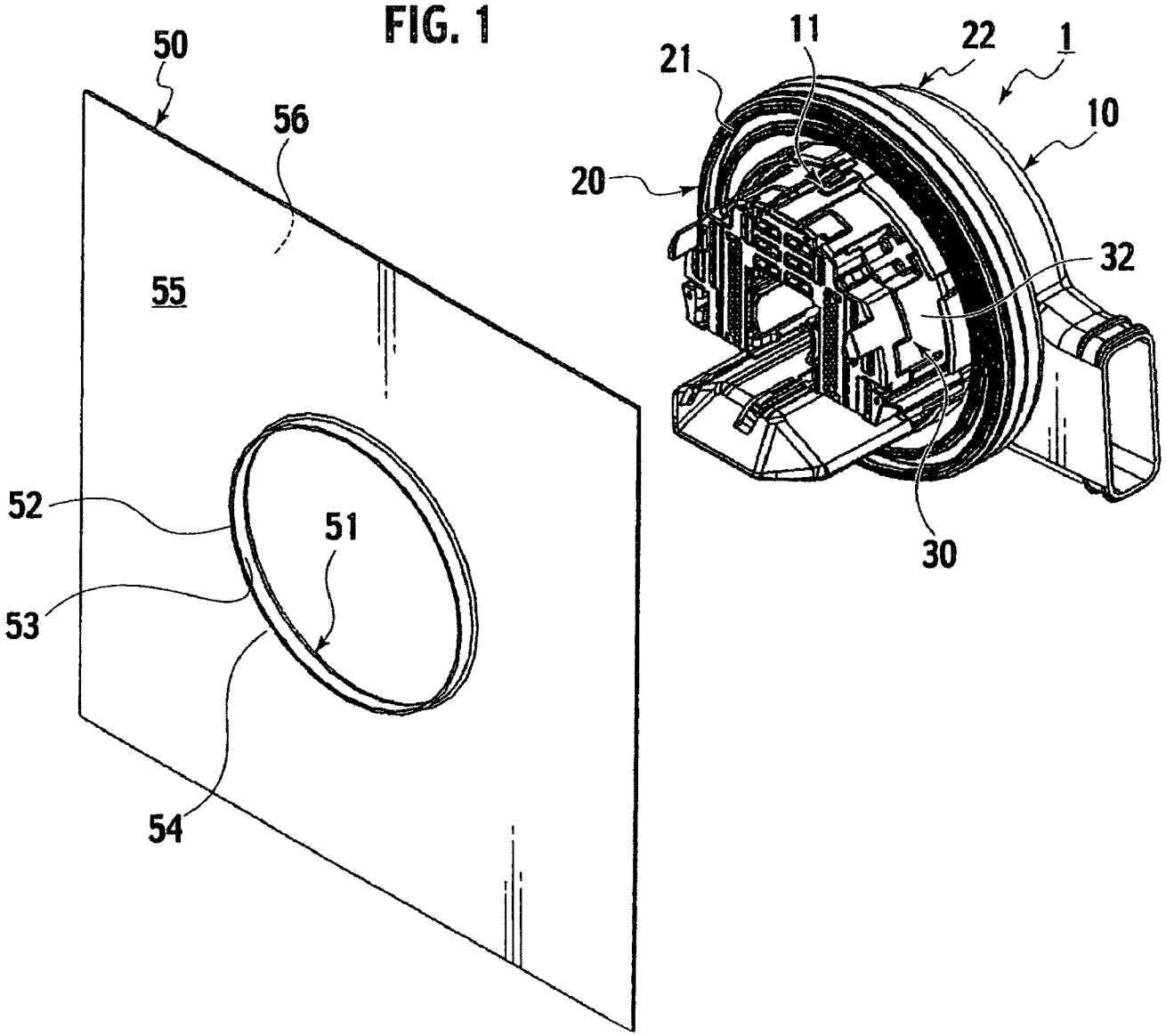
FIG. 1 is a perspective view showing a female connector which constitutes a through-panel connector in accordance with an embodiment of the present invention and a panel on which the through-panel connector is mounted.

Referring to accompanying drawings, a waterproof connector in accordance with one embodiment of the present invention will be described in detail, below. In the drawings, identical or similar elements are indicated with same or similar reference numerals, respectively. However, it should be noted that the drawings are typical ones and therefore, there are differences between elements in the drawings and actual elements, in terms of the relationship of each element between its thickness and dimensions in plan view, the percentage of a thickness of each layer and so on.

Figure 2:
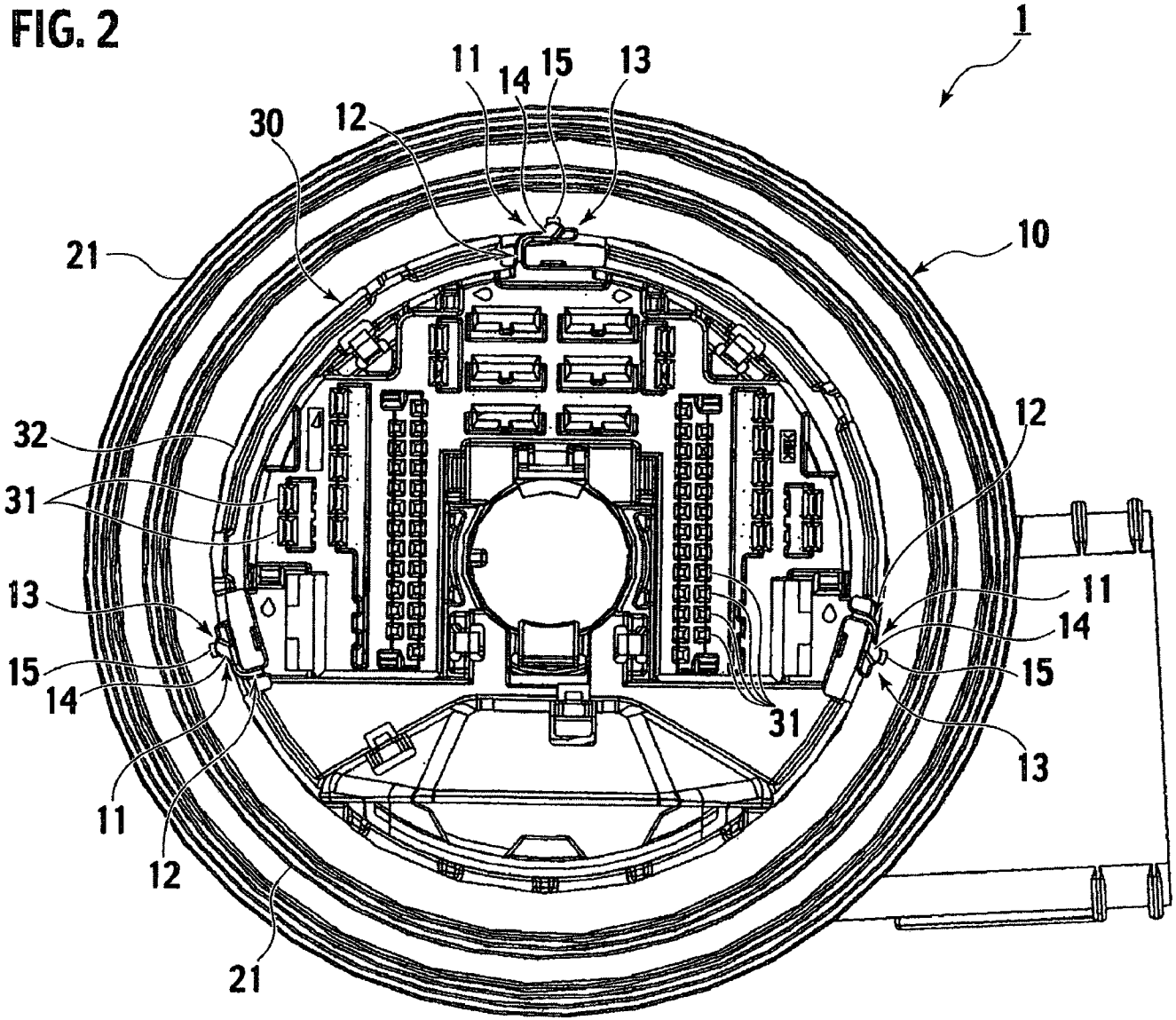
FIG. 2 is a front view of the female connector of the through-panel connector in accordance with the embodiment of the present invention.
Figure 3:
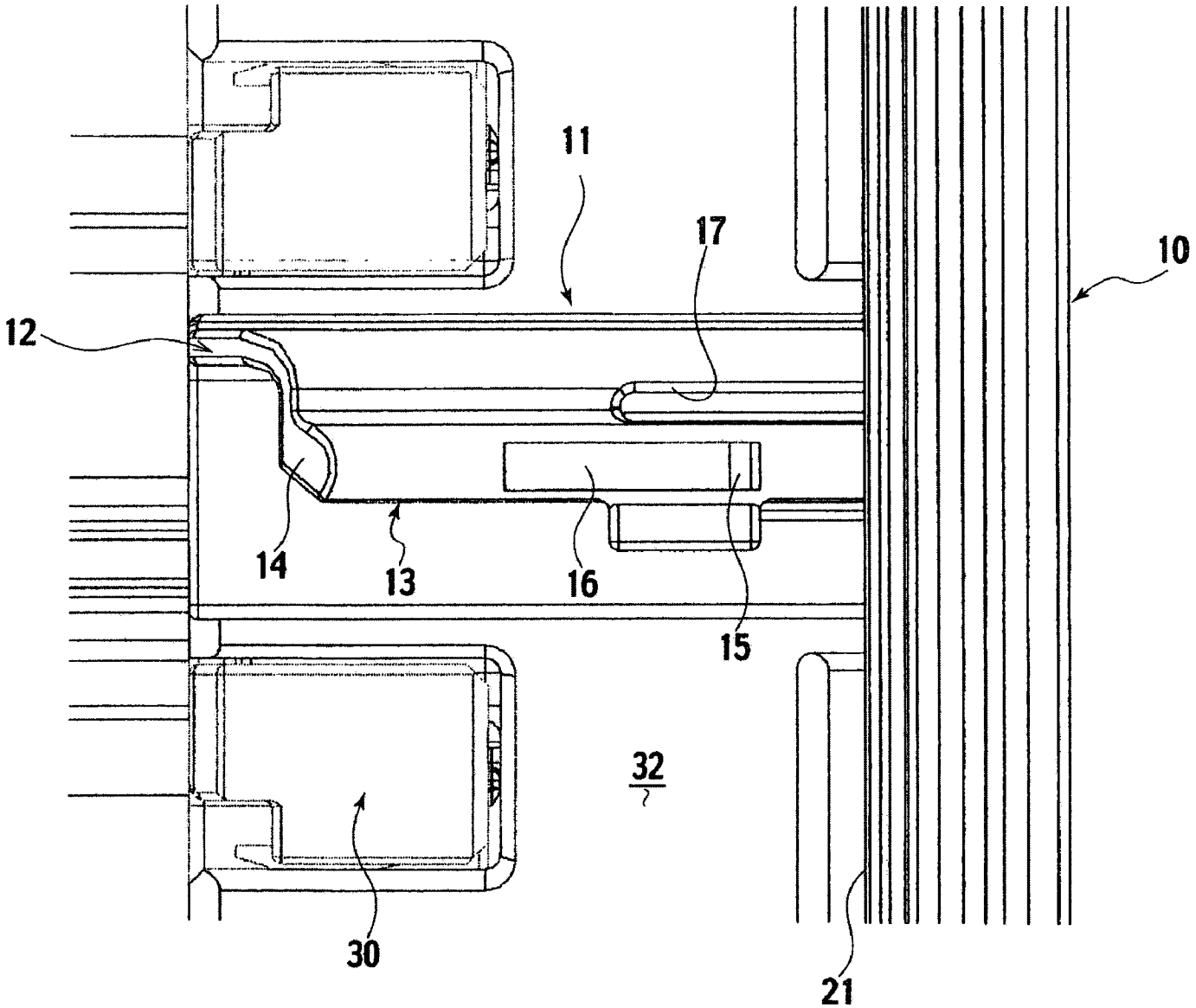
FIG. 3 is a top view of the female connector constituting the through-panel connector in accordance with the embodiment of the present invention.
Figure 4:
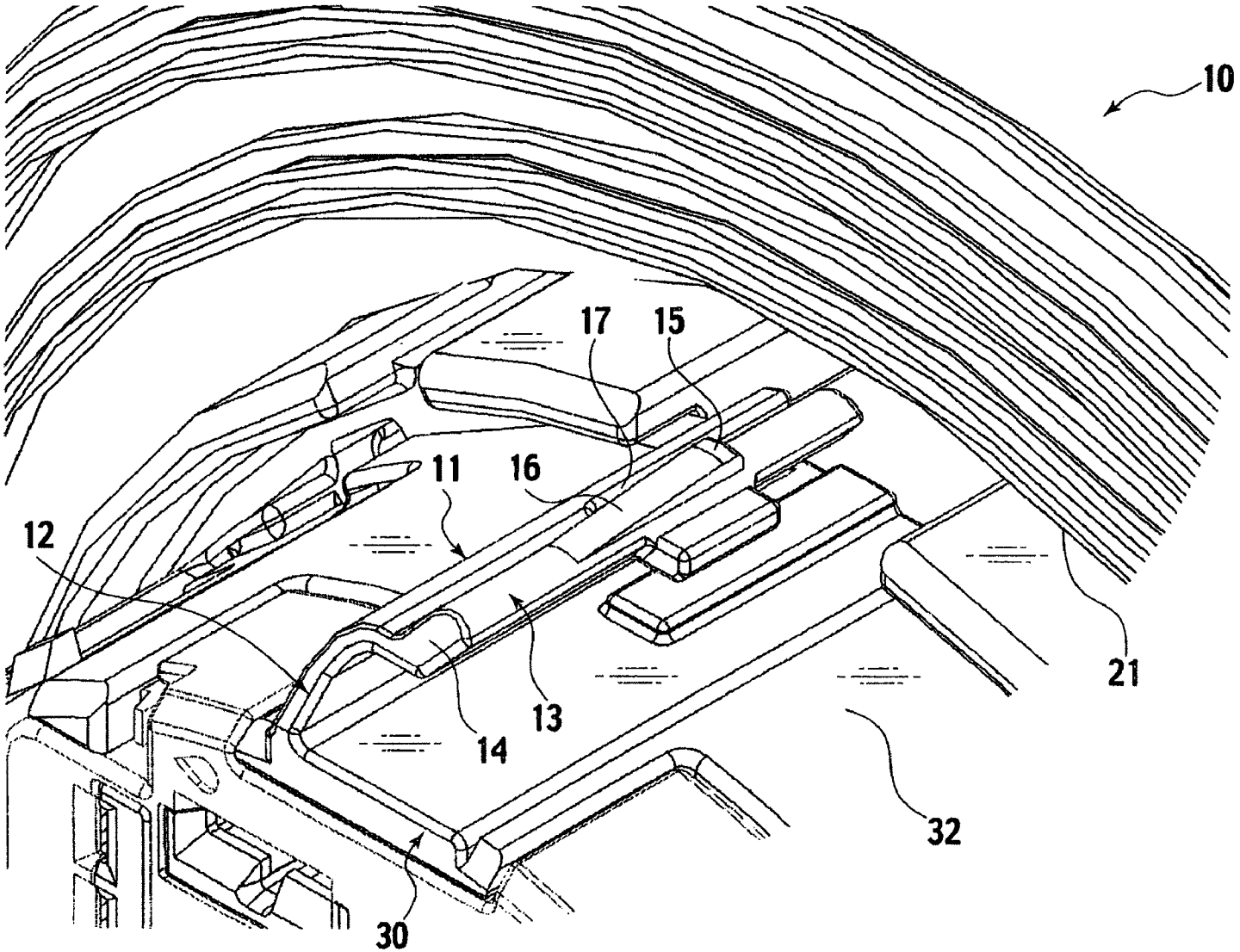
FIG. 4 is an enlarged perspective view of a holding rib of the female connector of the through-panel connector in accordance with the embodiment of the present invention.
Figure 5:
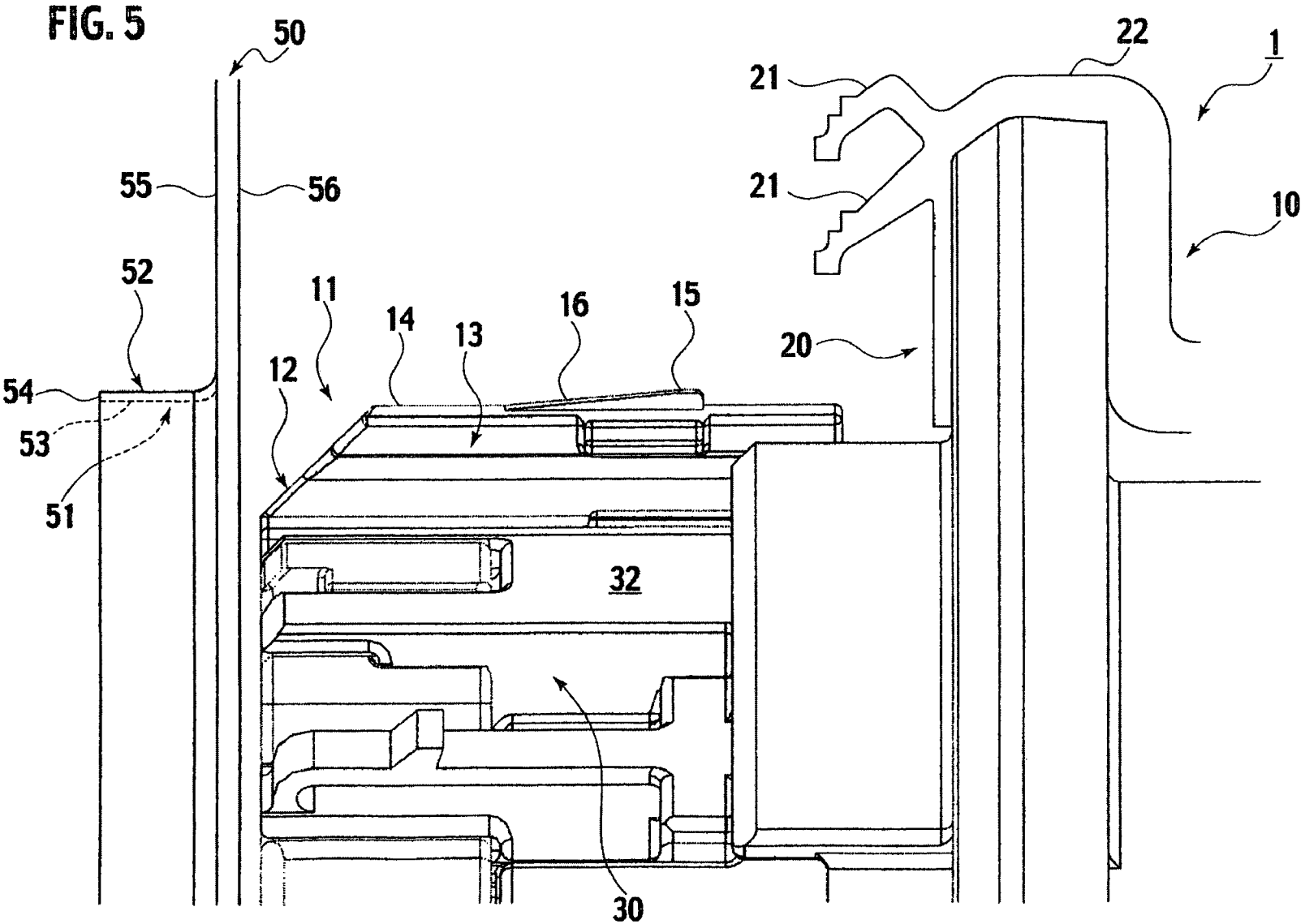
FIG. 5 is a side view showing the panel before assembling the through-panel connector in accordance with the embodiment of the present invention and the panel female connector.
Figure 6:
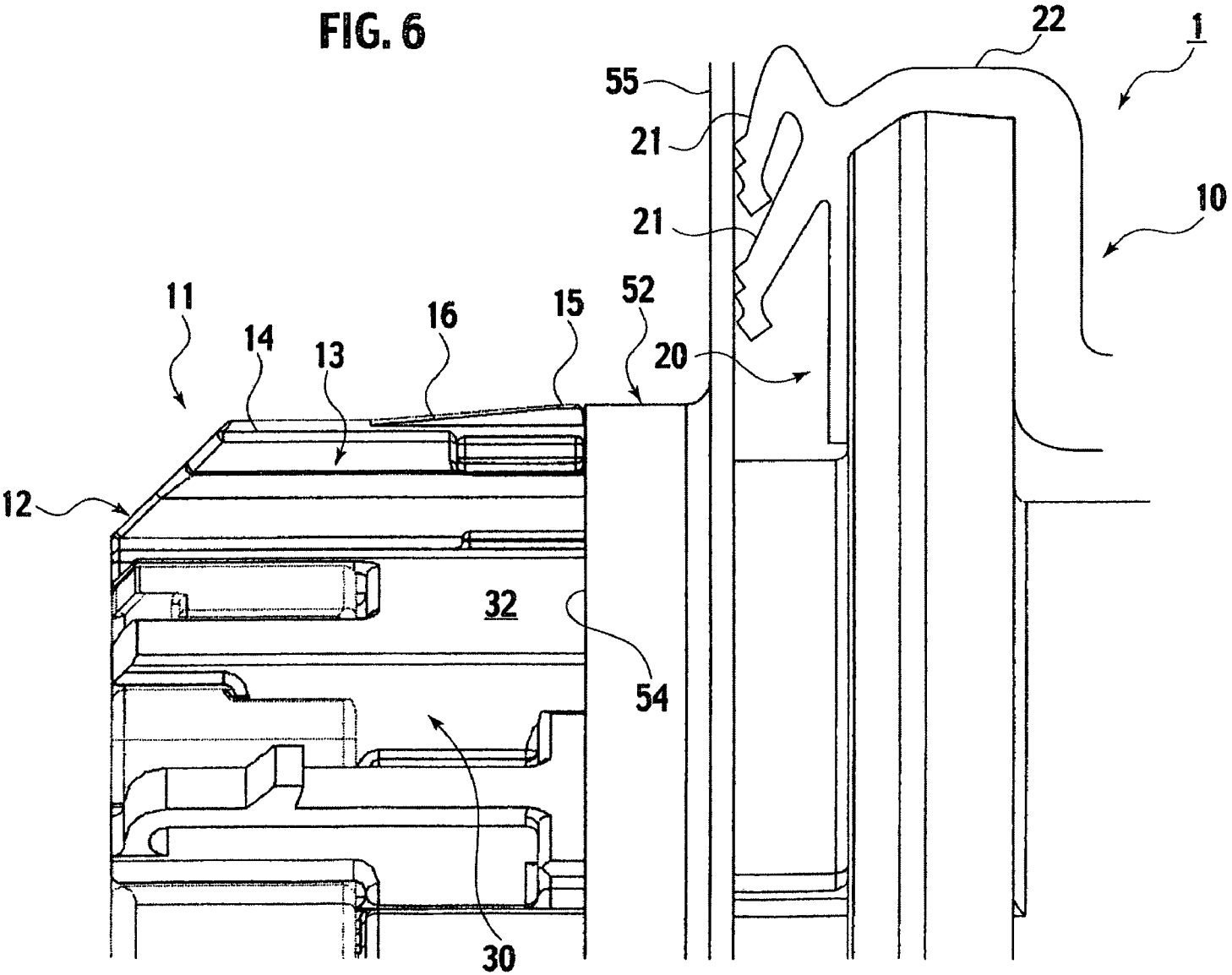
FIG. 6 is a side view showing the panel after assembling the through-panel connector in accordance with the embodiment of the present invention and the panel female connector.
Figure 7:
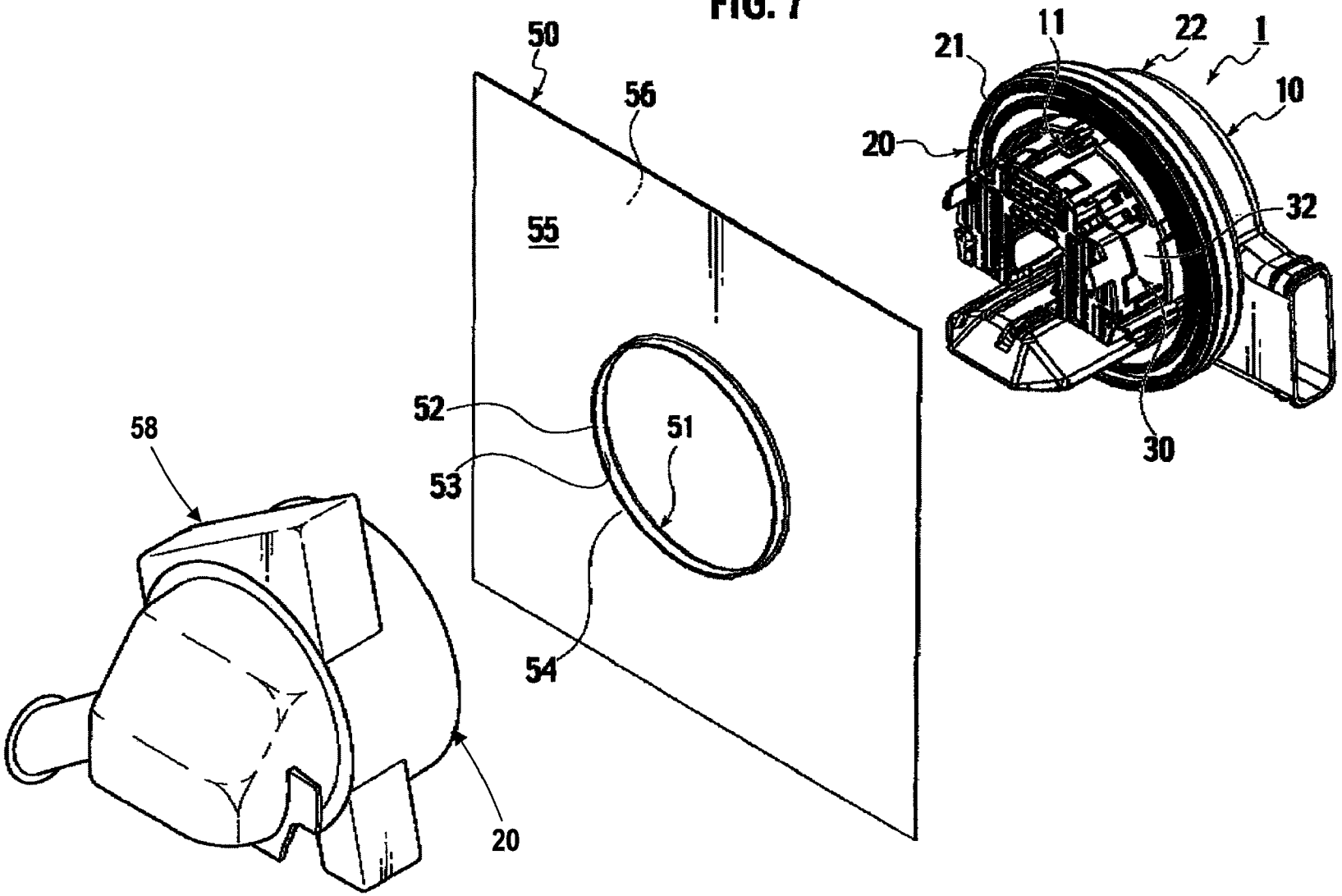
FIG. 7 is a perspective view showing a female connector and a male connector in accordance with an embodiment of the present invention and a panel on which the female and male connectors are mounted.
Figure 8:
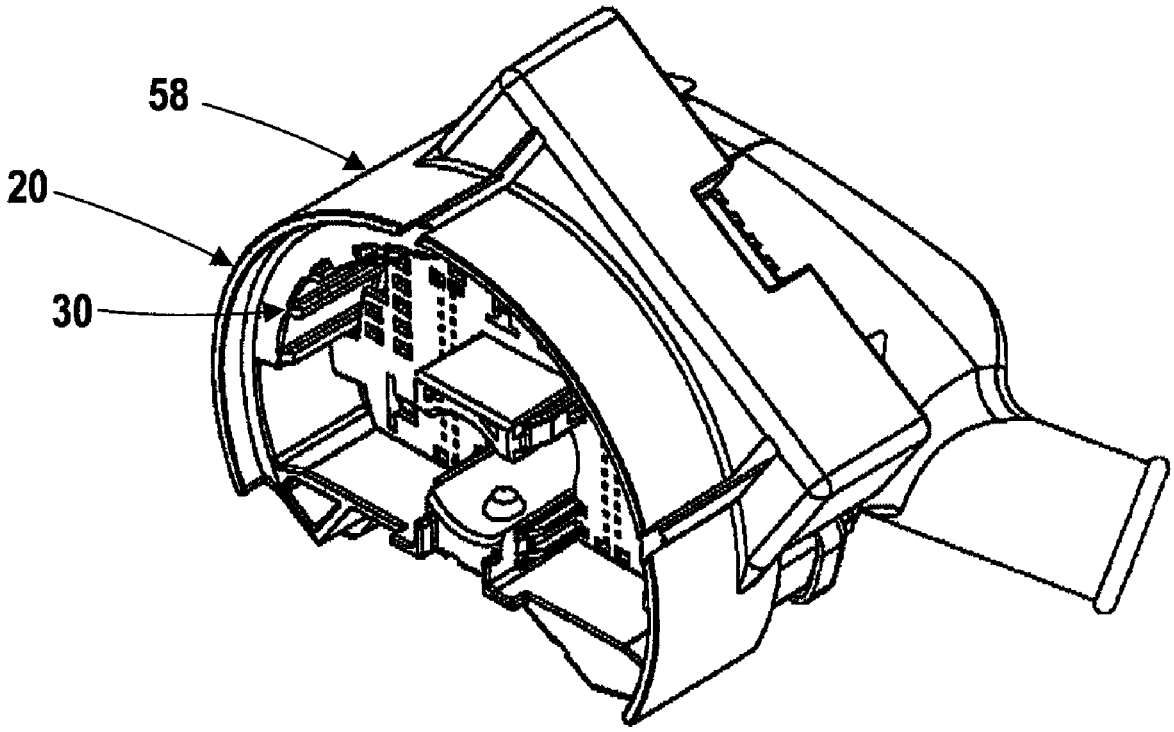
FIG. 8 is a perspective view of the male connector in accordance with the embodiment of the present invention.

FIG. 1 is a perspective view showing a female connector 10 of a through-panel connector 1 in accordance with an embodiment of the present invention and a panel 50 on which the through-panel connector 1 is mounted. FIG. 2 is a front view of the female connector 10 of the through-panel connector 1 in accordance with the embodiment of the present invention. FIG. 3 is a top view of the female connector 10 of the through-panel connector 1 in accordance with the embodiment of the present invention. FIG. 4 is an enlarged perspective view of a holding rib 11 of the female connector 1 of the through-panel connector in accordance with the embodiment of the present invention. FIG. 5 is a side view showing the panel 50 before assembling and the through-panel connector 1 in accordance with the embodiment of the present invention. FIG. 6 is a side view showing the panel 50 after assembling and the through-panel connector 1 in accordance with the embodiment of the present invention.

As shown in FIGS. 1 to 4, the through-panel connector 1 of this embodiment includes a female housing 10 as a first connector housing and a male housing 58 as a second connector housing. The female connector 10 and the male connector 58 are arranged on both sides of the panel 50 respectively and furthermore, respective terminals 31 of the female connector 10 and the male connector 58 are connected with each other through a mounting hole 51 formed in the panel 50.

The mounting hole 51 is provided with a torus part 52 having a substantially-cylindrical configuration. The torus part 52 is provided, on its inner periphery, with an inner peripheral surface 53 forming an inner peripheral surface of the mounting hole.

The female connector 10 and the male connector 58 have substantially-circular shaped cross sections and are together formed with connecting surfaces 20 as surfaces opposed to the panel 50.

Under condition that the female connector 10 is assembled to the panel 50, a part of the female connector 10 projecting from a back side 56 of the panel 50 and another part extending from the circumference of an outer rim of the connecting surface 20 up to the connecting surface 20 are covered by a grommet 22. The grommet 22 is provided, at its part covering the connecting surface 20 from the circumference of the outer rim of the connecting surface 20, with annular ribs 21 as a sealing part.

The annular ribs 21 are shaped and formed by material, such as rubber material and elastomer, having elasticity and capable of sticking fast to the panel 50 for contact.

Again, the annular ribs 21 are formed so as to lie outside the mounting hole 51 and describe concentric double circles in a condition where the through-panel connector 1 is mounted on the panel 50. Additionally, the annular ribs 21 are formed so as to gradually approach centers of the double circles as approaching ribs' tips.

Further, the female connector 10 and the male connector 58 have terminal accommodating parts 30 formed at respective central portions. When the terminal accommodating part 30 of the female connector 10 is inserted into the terminal accommodating part of the male connector 58, a mutual connection between terminals 31 of both connectors is accomplished.

The terminal accommodating part 30 of the female connector 10 is formed so as to project from the connecting surface 20 and allow the part 30 to be inserted into the mounting hole 51. On an outer peripheral surface 32 of the terminal accommodating part 30 opposed to the torus inner peripheral surface 53, additionally, holding ribs 11 are formed in three positions at substantially-even intervals.

Using material having flexibility, these holding ribs 11 are formed on the outer peripheral surface 32 so as to be extended along the inserting direction of the mounting hole 51 and separated from outer peripheral surface 32 while being extended from a base end part 12 to a tip part 13 along the torus inner peripheral surface 53. Under condition that the female connector 10 is mounted on the panel 50, the holding ribs 11 are retained in the torus inner peripheral surface 53 by force.

The holding ribs 11 are respectively provided, at their tip ends and on their outer peripheral sides, with "inner peripheral surface" abutment parts 14 that abut on the torus inner peripheral surface 53 on condition that the female connector 10 is mounted on the panel 50.

Again, the holding ribs 11 are respectively provided, on their tip sides, with engagement projections 15 that are engaged with an opening edge 54 of the torus part 52 as an opening edge of the mounting hole 51 on condition that the female connector 10 is mounted on the panel 50. Further, each engagement projection 15 is provided, on the side of a base end of the holding rib 11, with a slit 17 as a biasing-force adjusting part.

Next, we present a condition that the female connector 10 is mounted on the panel 50. As shown in FIGS. 1, 5 and 6, the female connector 10 is arranged on a backside 56 of a panel surface 55 provided with the torus part 52. The leading end of the terminal accommodating part 30 is inserted into the mounting hole 51. Then, the holding ribs 11 slide under their flexible deformations while the "inner peripheral surface" abutment parts 14 are contacting with the torus inner peripheral surface 53.

Subsequently, when the terminal accommodating part 30 is further inserted into the mounting hole 51, the holding rib 11 further bends at its portion of the slit 17, so that rib's part in contact with the torus inner peripheral surface 53 changes from the "inner peripheral surface" abutment part 14 to a sliding slant surface 16.

When further inserting the terminal accommodating part 30 into the mounting hole 51, the annular ribs 21 are pressed on the backside of the panel 50 and deformed elastically. Then, when inserting the terminal accommodating part 30 furthermore, the torus inner peripheral surface 53 climbs over the engagement projection 15, so that the engagement projection 15 is engaged with the opening edge 54 of the torus part 52.

Under condition that the engagement projection 15 is engaged with the opening edge 54 of the torus part 52, the "inner peripheral surface" abutment part 14 is forcibly retained in the torus inner peripheral surface 53 due to a repulsive force of the holding rib 11.

As for the other holding ribs 11 formed on the outer peripheral surface 32 of the terminal accommodating part 30, the engagement projections 15 are similarly engaged with the opening edge 54 of the torus part 52 with the insertion of the terminal accommodating part 30 into the mounting hole 51, so that the abutment parts 14 are forcibly retained in the torus inner peripheral surface 53. Consequently, the female connector 10 comes into contact with the torus inner peripheral surface 53 by only the "inner peripheral surface" abutment parts 14, accomplishing the positioning of the female connector 10.

In this way, the male connector is connected to the female connector 10 while the through-panel connector 1 under such a positioned condition is held by the panel 50.

Again, on condition that the through-panel connector 1 is held by the panel 50, the annular ribs 21 are interposed between the connecting surface 20 and the backside 56 of the panel 50 while being elastically deformed therebetween. Then, since the engagement projections 15 are engaged with the opening edge 54 in opposition to repulsive forces of the annular ribs 21, the annular ribs 21 stick fast to the backside 56 of the panel 50. Consequently, water tightness between the female connector 10 and the panel 50 is ensured.

As above, in the through-panel connector 1 of this embodiment, the plural flexible holding ribs 11 are formed on the outer peripheral surface 32 of the female connector 10 opposed to the torus inner peripheral surface 53 of the panel 50 along the inserting direction into the mounting hole 51, while the flexible holding ribs 11 have respective tips formed along the torus inner peripheral surface 53. Thus, the holding ribs 11 are forcibly held by the torus inner peripheral surface 53 on condition that the through-panel connector 1 is mounted on the panel 50, so that the positioning of the female connector 10 is accomplished by inserting the female connector 10 into the mounting hole 51 and furthermore, the force required to insert the female connector 10 into the mounting hole 51 can be generally equalized from beginning to end, whereby the fitting work can be simplified.

Further, in the through-panel connector 1 of this embodiment, owing to the provision of the engagement projections 15 for engagement with the opening edge 54 of the mounting hole 51 on the sides of respective tips of the holding ribs 11, both connector's positioning and assembling to the panel 50 can be performed by a single action, allowing the fitting work to be further simplified.

Further, in addition to the above effects, since respective holding forces to the torus inner peripheral surface 53 as the inner peripheral surface of the mounting hole are uniformed owing to the provision of the holding ribs 11 on the outer peripheral surface 32 at even intervals, the female connector 10 can be centered with respect to the mounting hole 51 by inserting the female connector 10 into the mounting hole 51. Thus, it is possible to accomplish the positioning of the female connector 10 to the panel more certainly.

Further, in the through-panel connector 1 of this embodiment, owing to the provision of the slits 17 as the biasing-force adjusting parts on the sides of respective base end parts of the holding ribs 11 of the engagement projections 15, it is possible to make a force for mounting the female connector 10 on the panel 50 equal to a force for positioning the female connector.

Further, owing to the provision of the torus part 52 about the mounting hole 51, it is possible to attach the through-panel connector 1 to the mounting hole 51 without reducing mechanical strength of the panel 50 in the circumference of the mounting hole 51.

Additionally, the annular ribs 21 arranged on the surface 20 of the connector housing 10 having the holding ribs 11, the surface 20 being opposed to the panel 50, are held between the surface 20 opposed to the panel 50 and the panel 50 on condition that the engagement projections 15 are engaged with the opening edge 54. Consequently, since the holding ribs 11 are engaged with the opening edge 54 in opposition to the repulsive forces of the annular ribs 21, it is possible to ensure a fastening span allowing the annular ribs 21 to exert sufficient water tightness stably.

Although the holding ribs 11 are formed on the outer peripheral surface 32 of the terminal accommodating part 30 of the female connector 10 in the embodiment, the similar effect would be obtained by an arrangement where the male connector 58 is formed so that its terminal accommodating part projects in order to allow its inserting into the mounting hole 51 and furthermore, holding ribs are formed on the outer peripheral surface of the terminal accommodating part.

As stated above, we describe the present invention by way of its embodiment. However, the present invention is not limited to this and therefore, constitution of respective parts may be replaced by optional constitutions having similar functions to those of the parts.

INDUSTRIAL APPLICABILITY

The present invention can provide a through-panel connector that can simplify its positioning with respect to a panel and thus simplify its installation work.

The invention claimed is:

1. A through-panel connector comprising:

a first connector housing disposed on one side of a panel; and a second connector housing disposed on an opposite side of the panel through a mounting hole formed in the panel, the first connector housing being fitted to the second connector housing;

wherein the first connector housing has a plurality of flexible holding ribs formed on an outer peripheral surface opposed to an inner peripheral surface of the mounting hole, wherein the holding ribs extend from a base end part standing on the outer peripheral surface and extend along a circumferential direction of the inner peripheral surface of the mounting hole and along an inserting direction into the mounting hole, wherein the holding ribs contact the inner peripheral surface of the mounting hole when the first connector housing is mounted on the panel, wherein the holding ribs include engagement projections engaged with an opening edge of the mounting hole, the engagement projections being formed on sides of respective tip parts of the holding ribs, and wherein the holding ribs include biasing-force adjusting parts for maintaining a constant biasing force of the holding ribs on the inner peripheral surface of the mounting hole of the panel, the biasing-force adjusting parts being formed on sides of the respective base end parts of the holding ribs beside the engagement projections.

2. The through-panel connector of claim 1, wherein the holding ribs are formed on the outer peripheral surface at even intervals.

3. The through-panel connector of claim 1, wherein the biasing-force adjusting parts have slits.

4. The through-panel connector of claim 1, wherein the first connector housing is provided on a surface opposed to the panel with a sealing part that is held between the surface opposed to the panel and the panel when the engagement projections are engaged with the opening edge of the mounting hole.

5. The through-panel connector of claim 1, wherein the engagement projections have sliding slant surfaces slanting upward in an opposite direction of the inserting direction, and wherein the sliding slant surfaces contact the inner peripheral surface of the mounting hole when the first connector housing is mounted on the panel.

6. The through-panel connector of claim 3, wherein each slit extends in an opposite direction of the inserting direction and has an opening edge in a side of the opposite direction of the inserting direction.

7. The through-panel connector of claim 1, wherein the constant biasing force is maintained when inner peripheral surface abutment parts of the holding ribs are positioned over the respective base end parts in an opposite direction of the inserting direction.

* * * * *